United States Patent [19]

Mifune

[11] Patent Number: 4,845,023

[45] Date of Patent: Jul. 4, 1989

[54] SILVER HALIDE PHOTOGRAPHIC LIGHT-SENSITIVE MATERIAL

[75] Inventor: Hiroyuki Mifune, Odawara, Japan

[73] Assignee: Fuji Photo Film Co., Ltd., Kanagawa, Japan

[21] Appl. No.: 73,127

[22] Filed: Aug. 19, 1987

Related U.S. Application Data

[63] Continuation-in-part of Ser. No. 844,494, Mar. 26, 1986, abandoned.

[30] Foreign Application Priority Data

Mar. 26, 1985 [JP] Japan ..... 60-61429
Mar. 26, 1985 [JP] Japan ..... 60-61430

[51] Int. Cl.[4] ..... G03C 1/08

[52] U.S. Cl. ..... 430/569; 430/599; 430/607; 430/627; 430/642; 430/935; 430/603; 430/604

[58] Field of Search ..... 430/569, 599, 607, 627, 430/642, 935, 603, 604

[56] References Cited

U.S. PATENT DOCUMENTS

| | | | |
|---|---|---|---|
| 2,678,885 | 5/1954 | Porter | 430/569 |
| 3,782,953 | 1/1974 | Maley | 430/569 |
| 3,873,323 | 3/1975 | Nakumura et al. | 430/570 |
| 4,419,443 | 12/1983 | Mitune et al. | 430/567 |
| 4,639,416 | 1/1987 | Yoshida et al. | 430/567 |

*Primary Examiner*—Paul R. Michl
*Assistant Examiner*—Lee C. Wright
*Attorney, Agent, or Firm*—Sughrue, Mion, Zinn, Macpeak & Seas

[57] ABSTRACT

A silver halide photographic light-sensitive material comprising at least one layer of a silver halide emulsion on a support is improved in shelf stability by treating a chemically sensitized silver halide emulsion with an ion-exchange resin or a porous absorbent to remove residue of the chemical sensitizer during and/or after chemical sensitization.

5 Claims, No Drawings

SILVER HALIDE PHOTOGRAPHIC LIGHT-SENSITIVE MATERIAL

This application is a continuation-in-part application of copending application Ser. No. 844,494 filed Mar. 26, 1986 now abandoned, entitled Silver Halide Photographic Light-Sensitive Material.

BACKGROUND OF THE INVENTION

This invention relates to silver halide photographic light-sensitive materials, and more particularly, to silver halide photographic light-sensitive materials having improved shelf life.

In general, silver halides used in silver halide photographic light-sensitive materials are chemically sensitized to provide the desired sensitivity and gradation. A number of chemical sensitization methods are known in the art, including sulfur sensitization using a compound containing sulfur capable of reacting with silver ions and active gelatin, reduction sensitization using a reducing substance, noble metal sensitization using compounds of gold and other noble metals, and combinations thereof. The sulfur sensitizers may include thiosulfates, thioureas, thiazoles, rhodanines, and analogues, and illustrative examples thereof are disclosed in U.S. Pat. Nos. 1,574,944; 2,410,689; 2,278,947; 2,728,668; 3,656,955; 4,030,928; and 4,067,740. The reduction sensitizers may include stannous salts, amine salts, hydrazine derivatives, formamidine sulfinic acid, silane compounds, and analogues, and illustrative examples thereof are disclosed in U.S. Pat. Nos. 2,487,850; 2,419,974; 2,518,698; 2,983,609; 2,983,610; 2,694,637; 3,930,867; and 4,054,458. For noble metal sensitization, there may be used complex salts of gold and complex salts of the metals of Group VIII in the Periodic Table, for example, platinum, iridium, and palladium, and illustrative examples thereof are disclosed in U.S. Pat. Nos. 2,399,083 and 2,448,060 and British Patent No. 618,061.

It was successively proposed to improve these well-known sensitization techniques by the combined use of such compounds as thiocyanates, thioethers as disclosed in U.S. Pat. No. 3,021,215, thion compounds as disclosed in Japanese Patent Publication No. 59-11892 and Japanese Patent Application Kokai No. 53-144319, imino compounds as disclosed in Japanese Patent Application Kokai Nos. 56-1042 and 57-82833, benzenesulfinic acid and derivatives, benzenethiosulfonic acid and derivatives, and N-halo compounds as disclosed in Japanese Patent Application Kokai No. 51-41056, thereby achieving further sensitization and controlled fogging.

Since all the amount of these chemical sensitizers and chemical sensitization aids added does not react to completion, chemical sensitization continues for an eternity.

The reaction is generally controlled by changing reaction environments, for example, reducing temperature or changing pH and pAg. In order to terminate chemical sensitization at the point of time when the desired photographic property is reached, it has been a common practice to add stabilizers and antifoggants, for example, organic heterocyclic compounds such as azaindenes (e.g., 4-hydroxy-6-methyl-1,3,3a,7-tetrazaindene), azoles (e.g., benzimidazoles, benztriazoles, benzthiazoliums, etc.), and mercapto compounds (e.g., mercaptotetrazoles, mercaptotriazoles, mercaptobenzimidazoles, mercaptopurines, etc.); and spectral sensitizing dyes and desensitizing dyes such as cyanine dyes and merocyanine dyes while effecting the reaction control by environmental changes.

Although the further progress of chemical sensitization is prevented by the addition of these compounds, there remain unreacted chemical sensitizers and chemical sensitization aids in a silver halide emulsion. Thus the chemically sensitized silver halide emulsion often changes its photographic properties with the lapse of time when it is stored in a refrigerator until it is coated onto a support, when it is being heated in solution form just before it is coated onto a support (that is, during so-called solution aging), or when it is stored after being coated onto a support.

Even those silver halide emulsions which have not been chemically sensitized often change their photographic properties with the lapse of time under the influence of compounds and concomitant impurities added during the preparation of silver halide grains.

Under these circumstances, there is the increasing need of improving the shelf stability of silver halide emulsions.

SUMMARY OF THE INVENTION

An object of the present invention is to provide a silver halide photographic light-sensitive material having improved shelf stability.

According to the present invention, there is provided a chemically sensitized silver halide photographic light-sensitive material comprising at least one layer of a silver halide emulsion on a support, wherein the silver halide emulsion has been treated with an ion-exchange resin and/or a porous adsorbent during its preparation, the treatment being conducted during and/or after chemical sensitization.

According to another aspect of the present invention, there is also provided a process for preparing a chemically sensitized silver halide photographic light-sensitive emulsion, comprising the steps of:

forming a silver halide photographic light-sensitive emulsion, adding a chemical sensitizer or chemical sensitization aid to the emulsion, and treating the emulsion with an ion-exchange resin and/or a porous adsorbent during and/or after chemical sensitization to thereby remove at least part of unreacted residue of the chemical sensitizer or chemical sensitization aid which is present in the emulsion.

DETAILED DESCRIPTION OF THE INVENTION

According to the present invention, a silver halide emulsion is treated with an ion-exchange resin and/or a porous adsorbent during and/or after chemical sensitization in a process of its preparation, before it is coated onto a support. The thus treated silver halide emulsion is used in the silver halide photographic light-sensitive material of the present invention. The treatment is to remove at least part of the unreacted residue of a chemical sensitizer or chemical sensitization aid which has been added to the silver halide emulsion. Better results are obtained by conducting the treatment during and/or after chemical sensitization.

In general, a silver halide emulsion is prepared by a process involving the steps of mixing alkali halide and silver nitrate in the presence of gelatin to form silver halide grains by any of the well-known techniques as will be described later, physical ripening, cooling, washing, heating, chemical sensitizing, and again cooling for solidification. More specifically of chemical sensitization, the initially formed silver halide emulsion is desalted, washed with water, dispersed in fresh gelatin, and adjusted for pH and pAg before it is subject to chemical sensitization by introducing a chemical sensitizer. The chemically sensitized emulsion is combined with various additives and then applied to a support.

According to the present invention, the emulsion is treated with an ion-exchange resin and/or porous adsorbent to remove the sensitizer residue during or after chemical sensitization. The term "during chemical sensitization" designates a period of chemical sensitization process between the addition of a chemical sensitizer and the start of cooling from the chemical ripening temperature, and the term "after chemical sensitization" designates a subsequent period from the start of cooling. In the practice of the present invention, the treatment may also be carried out for a period covering both during and after chemical sensitization.

A silver halide emulsion may be treated with an ion-exchange resin by any desired techniques including (1) adding batchwise the ion-exchange resin to the silver halide emulsion, agitating the resulting mixture for mixing, and then removing the ion-exchange resin by filtration, (2) continuously passing the ion-exchange resin through an adsorption bed or column filled with the ion-exchange resin, and (3) passing the silver halide emulsion in contact with a membrane of the ion-exchange resin.

The amount of the ion-exchange resin used may be suitably selected depending on the properties of the resin such as total exchange capacity, type of exchange group, and selectivity, the shape factors of the resin such as particle size and effective surface area, and factors associated with the silver halide emulsion to be treated such as the type and amount of a chemical sensitizer used therein.

For example, in the batchwise treatment, the ion-exchange resin may be added in an amount of about 0.1 to about 100 grams per kilogram of the silver halide emulsion. In the continuous treatment, the ion-exchange resin may be used in a similar range as used in the batchwise treatment because it may be considered the amount of an adsorbent required for the total amount of the silver halide emulsion passed therethrough.

The treating temperature may range from the temperature at which the silver halide emulsion is liquefied (approximately 30° C) to the heat resistant temperature of the resin. The treatment may be carried out for an appropriate time of at least one minute independent of whether it is batchwise or continuous.

The stage at which the treatment with ion-exchange resin is carried out may be selected as appropriate depending on the particular silver halide emulsion to be treated. Preferably the treatment is carried out at a stage from immediately after chemical ripening to immediately before coating. Most preferably, the treatment is carried out in a period from immediately after chemical ripening, that is, the start of cooling to stop chemical ripening and preserve the emulsion.

Some illustrative non-limiting examples of the ion-exchange resins used in the practice of the present invention include cation exchange resins such as Amberite IR-120 (trade name, manufactured by Rohm & Haas);

anion exchange resins such as Diaion SA-21A (trade name, manufactured by Mitsubishi Chemicals K.K.) and Dowex 1×8 (trade name, manufactured by Dow Chemicals);

amphoteric resins; and chelate resins such as Diaion CR-20 (trade name, manufactured by Mitsubishi Chemicals K.K.).

A variety of these ion-exchange resins are marketed and any particular one best suited for the purpose will be readily available.

Preferred among them are the anion exchange resins, amphoteric resins and chelate resins, with the anion exchange resins being most preferred.

The resinous base may be comprised of not only synthetic resins such as styrene-divinylbenzene copolymers, but also natural resins such as cellulosic resins.

The ion-exchange resins may take any desired forms including particulate, powder, and membrane forms, and any particular one which is easy to operate may be selected in accordance with the type of treatment. Examples of the membrane ion-exchange resins are Aciplex (trade name, manufactured by Asahi Chemicals K.K.) and Neoceptor (trade name, manufactured by Tokuyama Soda K.K.).

The ion-exchange resins should have dimensions greater than silver halide grains in the silver halide emulsion. There is the likelihood that after a silver halide emulsion is treated with an ion-exchange resin, part of the ion-exchange resin is left in the emulsion. Some ion-exchange resins are not detrimental, but some give a detrimental effect to the emulsion when present therein as residues. In general, the ion-exchange resin must be removed from the emulsion, for example, by filtration.

A silver halide emulsion may also be treated with a porous adsorbent by any desired techniques including (1) adding batchwise the porous adsorbent to the silver halide emulsion, agitating the resulting mixture for mixing, and then removing the porous adsorbent by filtration, and (2) continuously passing the porous adsorbent through an adsorption bed or column filled with the porous adsorbent.

The amount of the porous adsorbent used may be suitably selected depending on the properties of the adsorbent such as type, form, adsorption power, and adsorption capacity, and factors associated with the silver halide emulsion to be treated such as the type and amount of a chemical sensitizer used therein.

For example, in the batchwise treatment, the porous adsorbent may be added in an amount of about 0.05 to about 100 grams per kilogram of the silver halide emulsion. In the continuous treatment, the porous adsorbent may be used in a similar range as used in the batchwise treatment because it may be considered the amount of an adsorbent required for the total amount of the silver halide emulsion passed therethrough.

The treating temperature and time are essentially the same as described for the ion-exchange resins.

The porous adsorbents used in the practice of the present invention are porous solid adsorbents having a great surface area, and some illustrative non-limiting examples thereof include porous inorganic adsorbents such as active carbon, active alumina, activated clay, silica adsorbents (preferably water-resistant), zeolite adsorbents, porous glass, and porous ceramics.

The most preferred adsorbent is active carbon.

The porous adsorbents may take any desired forms including particulate, powder, fiber, and membrane forms. Since a variety of such porous adsorbents are commercially available, any particular one best suited for the purpose may be readily selected.

It is intended in the present invention to remove part or most of the unreacted residue of a chemical sensitizer or chemical sensitization aid added to a silver halide emulsion by treating the emulsion with an ion-exchange resin or a porous adsorbent, thereby achieving a unique effect. This method belongs to a completely different category from the conventional techniques of adding a stabilizer, antifoggant, dye or the like to prevent the further progress of chemical sensitization.

In the practice of the present invention, the treatment of the present invention may be incorporated in a process for the preparation of a silver halide emulsion separately, but preferably in combination with any desired one of the conventional techniques of adding a stabilizer (typically, 4-hydroxy-6-methyl-1,3,3a,7-tetrazaindene), antifoggant, dye or the like.

The photographic emulsions used in the practice of the present invention may contain any desired silver halides including silver bromide, silver iodobromide, silver iodochlorobromide, silver chlorobromide, silver iodide, and silver chloride.

The grain size distribution of the silver halides may be either broad or narrow.

Examples of the silver halide grains in the photographic emulsions include grains having a regular crystal form such as cube, octahedron, tetradecahedron, and rhombic dodecahedron, an irregular crystal form such as sphere and plate, or a composite form of these crystal forms, or a mixture of different crystal form grains.

The silver halide grains may have a homogeneous phase throughout the grain or be comprised of a core and a shell of different phases.

Further examples of the silver halide grains include junction type silver halide crystals having silver halide crystals (such as silver chloride crystals) bonded to oxide crystals (such as PbO), epitaxially grown silver halide crystals (such as silver bromide having silver chloride, silver iodobromide, silver iodide or the like epitaxially grown thereon), and crystals of hexagonal silver iodide having regular hexahedral silver chloride orientatedly overgrown.

The silver halide grains in the photographic emulsions may have any desired grain size distribution or of a monodispersion system. By the term monodispersion is meant a dispersion system wherein 95% of the grains fall within a range of ±60% of the number average grain size, preferably within a range of ±40% of the number average grain size. The number average grain size is a number average diameter calculated from projected area diameters of silver halide grains.

In the practice of the present invention, the photographic emulsions may be prepared by any well-known conventional processes as disclosed in P. Glafkides, Chimie et Physique Photographique, Paul Montel (1967); G. F. Duffin, Photographic Emulsion Chemistry, The Focal Press (1966); and V. L. Zelikman et al, Making and Coating Photographic Emulsion, The Focal Press (1964). They may be prepared by any of acidic, neutral, and ammoniacal methods. The reaction of a soluble silver salt with a soluble halide salt may be effected by any of the well-known conventional methods including a single jet method, a double jet method, and a combination thereof. Also employable is a method of forming silver halide grains in the presence of excess silver ions, which method is also known as back mixing method. One useful double jet method is by keeping constant the pAg of a liquid phase in which sliver halide is produced. This method is also known as a controlled double jet method and produces a silver halide emulsion of grains having a regular crystal form and an approximately equal grain size.

A mixture of two or more separately prepared silver halide emulsions may also be used.

During the formation or physical ripening of silver halide grains, there may be copresent an additional salt such as cadmium salts, zinc salts, lead salts, thalium salts, iridium salts and complex salts, rhodium salts and complex salts, iron salts and complex salts. These salts may be added in more or less amounts depending on the intended light-sensitive material.

Removal of soluble salts from the emulsion after precipitation or physical ripening may be carried out by noodle rinsing methods requiring gelation of gelatin or flocculation methods using inorganic salts, anionic surface active agents, anionic polymers (such as polystyrene sulfonate), and gelatin derivatives (such as acylated gelatins and carbamoylated gelatins).

The silver halide emulsions is then chemically sensitized. Chemical sensitization may be carried out by any desired methods as disclosed in H. Frieser ed., Die Grundlagen der Photographischen Prozesse mit Silberhalogeniden, Akademische Verlagsgesellschaft (1968), pages 675–734. More particularly, use may be made of sulfur sensitization methods using sulfur-containing compounds capable of reacting with active gelatin and silver, reduction sensitization methods using reducing substances, noble metal sensitization methods using noble metal compounds, and a combination thereof. Some illustrative non-limiting examples of the sulfur-containing compounds include thiosulfates, thioureas, mercapto compounds, and rhodanines; examples of the reducing substances include stannous salts, amines, hydrazines, formamidine sulfinic acid, and silane compounds; and examples of the noble metal compounds include gold complex salts, and complex salts of Group VIII metals in the Periodic Table including Pt, Ir, and Pd. For further detail, reference is made to the patents incorporated in the preamble.

In general, the chemical ripening is carried out at a temperature in the range from 40° C. to 90° C. for a time of from 0.05 to 5 hours.

The photographic emulsions used in the present invention may further contain any of various known additives for the purposes of preventing fogging of photographic materials during their preparation, storage or photographic processing and stabilizing photographic properties. The additives which can be added to the emulsions include a number of compounds known as antifoggants and stabilizers, for example, azoles such as benzothiazolium salts, nitroindazoles, triazoles, benzotriazoles, and benzimidazoles (especially, nitro- and halo-substituted derivatives); heterocyclic mercapto compounds such as mercaptothiazoles, mercaptobenzothiazoles, mercaptobenzimidazoles, mercaptothiadiazoles, mercaptotetrazoles (especially, 1-phenyl-5-mercaptotetrazole), and mercaptopyrimidines; derivatives of the aforementioned heterocyclic mercapto compounds having a water-soluble group such as a carboxyl group and a sulfone group; thioketo compounds such as oxazolinethiones; azaindenes such as tetraazaindenes (especially, 4-hydroxy substituted (1,3,3a,7)-tetraazaindenes); benzenethiosulfonates; and benzenesulfinic acid.

For further information, reference may be made to E. J. Birr, Stabilization of Photographic Silver Halide Emulsions, The Focal Press (1974).

No particular limitation is imposed on color couplers, binders, hardening agents, matte agents, surface active agents, anti-discoloration agents, sensitizing dyes, dyes, polymer latexes, supports and other members which are used to produce silver halide photographic light-sensitive materials using silver halide emulsions as prepared by the method of the present invention. Reference is made to, inter alia, Research Disclosure, Vol. 176 (December 1976), pages 21–31.

According to the present invention, a silver halide emulsion is treated with an ion-exchange resin and/or a porous adsorbent while it is prepared, more particularly during and/or after chemical sensitization, and before it is coated onto a support. There is thus obtained a silver halide photographic light-sensitive material having improved shelf stability. The light-sensitive material of the present invention may include a single layer or plural layers of silver halide emulsion. The light-sensitive material of the present invention may contain a mixture of a silver halide emulsion treated according to the present invention and another silver halide emulsion prepared by a method other than the present invention. Furthermore, the light-sensitive material of the present invention may include a layer of a silver halide emulsion treated according to the present invention and another layer of a silver halide emulsion prepared by a method other than the present invention.

EXAMPLES

In order to demonstrate the benefits of the present invention, examples thereof are given by way of illustration and not by way of limitation.

Example 1

Ammonia was added to an aqueous gelatin solution containing potassium bromide at 70° C. with vigorous stirring, and then an aqueous silver nitrate solution and a mixed aqueous solution of potassium bromide and potassium iodide were added thereto at the same time. There was obtained a silver iodobromide emulsion having an average grain size of about 0.8 μm and an iodide content of 5 mol %.

The emulsion was then washed with water and desalted in a conventional manner by a flocculation method, adjusted to pH 6.5 and pAg 8.9, and divided into several portions each of 200 grams. They were heated to a temperature of 62° C. and combined with 4.8 mg of 5-benzylidene-3-propyl rhodanine, 2.0 mg of chloroauric acid, 68 mg of potassium thiocyanate, 4.2 mg of tetramethylthiourea, and 1.4 mg of sodium benzenethiosulfonate per mole of the silver halide, and then ripened for 55 minutes.

An ion-exchange resin in an amount as shown in Table 1 was added to a first 200-gram portion of the silver halide emulsion when 45 minutes had passed since the addition of the chemical sensitizers mentioned above, and agitation of the emulsion was continued throughout the ripening period. At the end of ripening, the emulsion was cooled with stirring until the temperature reached 40° C. Agitation was continued for a further 10 minutes at the temperature of 40° C. Immediately thereafter, the silver halide emulsion was passed three times through a microfilter to remove the ion-exchange resin therefrom.

For those emulsion portions which were ripened in the absence of an ion-exchange resin, they were cooled to a temperature of 40° C. Various ion-exchange resins as shown in Table 1 were added to these emulsion portions. Immediately after each mixture was agitated for 10 minutes, it was filtered three times through a microfilter to remove the ion-exchange resin from the silver halide emulsion.

The sensitizing dye, coupler, stabilizer, gelatin hardening agent, and coating aid all identified below were added to the thus obtained emulsions, which were coated onto cellulose acetate film supports and dried, obtaining sample Nos. 2 to 7.

For comparison purposes, sample No. 1 was prepared by preparing a similar emulsion without treating it with an ion-exchange resin, and coating and drying in the same manner as described above.

Since the emulsions underwent a slight change in pH and pAg due to treatment with the ion-exchange resins, they were readjusted to the same pH and pAg as that of the untreated emulsion in the duration from the removal of the ion exchange resin to the coating.

Sensitizing dye:

sodium 5,5'-dichloro-3,3'-di(γ-sulfopropyl)-9-ethyloxacarbocyanine

Stabilizer:

4-hydroxy-6-methyl-1,3,3a,7-tetraazaindene

Coupler:

1-(2,4,6-trichlorophenyl)-3-[3-(2,4-di-t-amylphenoxy)acetamide]benzamide-5-pyrazolone Gelatin hardening agent:

sodium 2,4-dichloro-6-hydroxy-s-triazine

Coating aid:

sodium dodecylbenzenesulfonate

These samples, Nos. 1 to 7, were exposed to light via an optical wedge for 1/100 second and then subjected to a color development as follows.

| Development steps: | |
|---|---|
| 1. Color development | 2'45" (38° C.) |
| 2. Bleaching | 6'30" |
| 3. Washing | 3'15" |
| 4. Fixing | 6'30" |
| 5. Washing | 3'15" |
| 6. Stabilization | 3'15" |

The processing solutions used in these steps have the following compositions.

| | |
|---|---|
| Color developing solution: | |
| Sodium nitrilotriacetate | 1.0 gram |
| Sodium sulfite | 4.0 grams |
| Sodium carbonate | 30.0 grams |
| Potassium bromide | 1.4 grams |
| Hydroxylamine sulfuric acid | 2.4 grams |
| 4-(N—ethyl-N—β-hydroxyethylamino)-2-methyl-aniline sulfuric acid | 4.5 grams |
| Water | balance to 1 liter |
| Bleaching solution: | |
| Ammonium bromide | 160.0 grams |
| Aqueous ammonia (28%) | 25.0 ml |
| Ethylenediamine tetraacetic acid sodium iron salt | 130 grams |
| Glacial acetic acid | 14 ml |
| Water | balance to 1 liter |
| Fixing solution: | |
| Sodium tetrapolyphosphate | 2.0 grams |
| Sodium sulfite | 4.0 grams |

-continued

| | |
|---|---|
| Ammonium thiosulfate (70%) | 175.0 ml |
| Sodium disulfite | 4.6 grams |
| Water | balance to 1 liter |
| Stabilizing solution: | |
| Formalin | 8.0 ml |
| Water | balance to 1 liter |

Additionally, the coated samples prepared as above, but not exposed to light were stored in an atmosphere having a temperature or 45° C. and a relative humidity (RH) of 80% for three days before they were similarly exposed to light and developed.

The results are shown in Table 1.

Relative sensitivity (RS) is a relative value given by the inverse of an exposure required to achieve an optical density corresponding to a fog value of +0.2, provided that sample No. 1 has a relative sensitivity of 100 immediately after coating.

TABLE 1

| Sample | Ion-exchange resin** | | | Immediately after coating | | 3 day storage at 45° C., 80% RH | |
|---|---|---|---|---|---|---|---|
| No. | Type | during CS | after CS | Fogging | RS | Fogging | RS |
| 1* | — | — | — | 0.08 | 100 | 0.06 | 78 |
| 2 | Dowex 1 × 8 (1.2 g) | — | add | 0.08 | 100 | 0.06 | 85 |
| 3 | Dowex 1 × 8 (3.0 g) | add | add | 0.07 | 98 | 0.05 | 87 |
| 4 | Dowex 1 × 8 (3.0 g) | — | add | 0.08 | 100 | 0.06 | 87 |
| 5 | Diaion AA-21A (3.0 g) | — | add | 0.08 | 100 | 0.06 | 84 |
| 6 | Diaion CR-20 (3.0 g) | — | add | 0.08 | 100 | 0.06 | 84 |
| 7 | Amberite IR-120 (3.0 g) | — | add | 0.08 | 100 | 0.06 | 82 |

*comparison
**trade names
Dowex 1 × 8: an anion exchange resin manufactured by Dow Chemical Co.
Diaion SA-21A: an anion exchange resin manufactured by Mitsubishi Chemicals K.K.
Diaion CR-20: a chelate resin manufactured by Mitsubishi Chemicals K.K.
Amberite IR-120: a cation exchange resin manufactured by Rohm & Haas Co.
The headings "during and after CS" are the ion-exchange resin addition stages during or after chemical sensitization As evident from the data in Table 1 that those samples treated with an ion-exchange resin undergo a less reduction in sensitivity during shelf storage. The coated samples are improved in aging resistance.

Example 2

With vigorous stirring, 3,6-dithia-1,8-octanediol was added to an aqueous gelatin solution kept at 70° C., and then an aqueous silver nitrate solution and a mixed aqueous solution of potassium bromide and potassium iodide were added thereto at the same time. During the addition pAg was kept at 8.1. There was obtained a monodispersed silver iodobromide emulsion containing a major proportion of tetradecahedral grains and having an average grain size of about 0.5 μm and an iodide content of 3 mol %.

The emulsion was then washed with water and desalted in a conventional manner by a flocculation method, adjusted to pH 6.5 and pAg 8.7, and divided into three portions of each 500 grams. They were each combined with 6.2 mg of sodium thiosulfate, 4.5 mg of chloroauric acid, 80 mg of potassium thiocyanate, and 1.8 mg of sodium benzenethiosulfonate per mole of the silver halide, and then ripened at 6° C. for 40 minutes.

An ion-exchange resin, Dowex 1×8, 4.5 grams was added to a first 500-gram portion of the silver halide emulsion when 35 minutes had passed since the addition of the chemical sensitizers mentioned above, and agitation of the emulsion was continued throughout the ripening period. At the end of ripening, the emulsion was cooled with stirring until the temperature reached 40° C. Agitation was continued for a further 10 minutes at the temperature of 40° C. Immediately thereafter, the silver halide emulsion was passed three times through a microfilter to remove the ion-exchange resin therefrom.

For the second and third emulsion portions which were ripened in the absence of an ion-exchange resin, they were cooled to a temperature of 40° C. The second portion was used as such. The third portion was combined with 4.5 grams of an ion-exchange resin (Dowex 1×8) per 500 grams of the emulsion and agitated for 10 minutes, and the mixture was filtered three times through a microfilter to remove the ion-exchange resin from the silver halide emulsion. Thereafter, an equal amount (0.72 grams) of 4-hydroxy-6-methyl-(1,3,3a,7)-tetrazaindene was added to each of the emulsions.

Sodium dodecylbenzenesulfonate as a coating aid and sodium 2,4-dichloro-6-hydroxy-s-triazine as a gelatin hardening agent were added to each of the emulsions, which were coated onto cellulose acetate film supports and dried, obtaining sample Nos. 21–23 as shown in Table 2.

These samples were exposed to light via an optical wedge and then developed at 20° C. for 10 minutes with a D19 developing solution formulated by Kodak, stopped, and fixed.

Separately, the treated and untreated emulsions prepared above were stored in a refrigerator for 90 days before they were combined with the same additives, coated, exposed, and developed by the same procedures as above. Samples corresponding to sample Nos. 21, 22 and 23 are designated sample Nos. 21′, 22′ and 23′.

The results are shown in Table 2.

The relative sensitivity (RS) has the same definition as described in Example 1 and expressed based on a relative sensitivity of 100 for sample No. 21.

TABLE 2

| Sample No. | Ion-exchange resin added: During Chemical sensitization | Ion-exchange resin added: After Chemical sensitization | RS |
|---|---|---|---|
| 21 comparison | — | — | 100 |
| 21′ comparison | — | — | 85 |
| 22 invention | add | add | 98 |
| 22′ invention | add | add | 95 |
| 23 invention | — | add | 100 |
| 23′ invention | — | add | 95 |

As evident from the data of Table 2, chemically sensitized solid emulsions treated according to the present invention exhibit improved stability during storage in a refrigerator.

Example 3

The procedure of Example 1 was repeated except that instead of the ion-exchange resins used in Example 1, active carbon was added in amounts per 200 grams of the emulsion as shown in Table 3. The resulting samples were evaluated by the same test procedures as in Example 1 and compared with sample No. 1.

The results are shown in Table 3.

TABLE 3

| Sample No. | Porous adsorbent Type | During CS | After CS | Immediately after coating Fogging | RS | 3 day storage at 45° C., 80% RH Fogging | RS |
|---|---|---|---|---|---|---|---|
| 1 | — | — | — | 0.08 | 100 | 0.06 | 78 |
| 32 | active carbon (0.4 g) | — | add | 0.08 | 100 | 0.06 | 82 |
| 33 | active carbon (1.0 g) | add | add | 0.06 | 98 | 0.05 | 85 |
| 34 | active carbon (1.0 g) | — | add | 0.08 | 100 | 0.06 | 86 |
| 35 | active carbon (2.0 g) | — | add | 0.08 | 100 | 0.07 | 88 |

As evident from the data in Table 3 that those samples treated with a porous adsorbent undergo a less reduction in sensitivity during shelf storage. The coated samples are improved in aging resistance.

Example 4

The procedure of Example 2 was repeated except that instead of the ion-exchange resin, active carbon was added in an amount of 1.5 grams per 500 grams of the emulsion. Samples prepared from a fresh emulsion is designated sample Nos. 42 and 43 and samples prepared from an emulsion stored in a refrigerator is designated sample Nos. 42′ and 43′.

The results are shown in Table 4 along with the data of sample Nos. 21 and 21′.

TABLE 4

| Sample No. | Active carbon added During Chemical sensitization | After | RS |
|---|---|---|---|
| 21 comparison | — | — | 100 |
| 21′ comparison | — | — | 85 |
| 42 invention | add | add | 97 |
| 42′ invention | add | add | 93 |
| 43 invention | — | add | 100 |
| 43′ invention | — | add | 93 |

As evident from the data of Table 4, chemically sensitized solid emulsions treated according to the present invention exhibit improved stability during storage in a refrigerator.

I claim:

1. A process for preparing a chemically sensitized silver halide photographic light-sensitive emulsion, comprising the steps of:

forming a silver halide photographic light-sensitive emulsion, adding a chemical sensitizer or chemical sensitization aid to the emulsion, and treating the emulsion with an ion-exchange resin and/or a porous adsorbent during and/or after chemical sensitization to thereby remove at least part of unreacted residue of the chemical sensitizer or chemical sensitization aid which is present in said emulsion.

2. The process of claim 1, wherein said treatment is carried out during said chemical sensitization.

3. The process of claim 1, wherein said treatment is carried out after said chemical sensitization.

4. The process of claim 1, wherein said treatment is with said ion-exchange resin.

5. The process of claim 1, wherein said treatment is with said porous adsorbent.

* * * * *